US009492935B2

(12) United States Patent
Gerke et al.

(10) Patent No.: US 9,492,935 B2
(45) Date of Patent: Nov. 15, 2016

(54) APPARATUS FOR GROOVING CARDBOARD CUTTINGS

(71) Applicant: Kolbus GmbH & Co. KG, Rahden (DE)

(72) Inventors: Klaus Gerke, Bassum (DE); Gerhard Lintelmann, Rahden (DE); Leonid Ugorets, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 601 days.

(21) Appl. No.: 13/940,386

(22) Filed: Jul. 12, 2013

(65) Prior Publication Data

US 2014/0013919 A1 Jan. 16, 2014

(30) Foreign Application Priority Data

Jul. 12, 2012 (DE) ..... 10 2012 013 807

(51) Int. Cl.
*B26D 3/06* (2006.01)
*B31B 1/25* (2006.01)
*B42C 7/00* (2006.01)

(52) U.S. Cl.
CPC ..... *B26D 3/065* (2013.01); *B31B 1/25* (2013.01); *B42C 7/005* (2013.01); *B31B 2201/25* (2013.01); *Y10T 83/0304* (2015.04)

(58) Field of Classification Search
None
See application file for complete search history.

(56) References Cited

U.S. PATENT DOCUMENTS 1,289,271 A 12/1918 Rosen, Jr.
2,240,765 A 5/1941 Dryer
2,500,338 A * 3/1950 Bergstein ..... B29C 53/063 220/62
3,550,509 A * 12/1970 Mittermayer ..... B31B 1/00 118/681
4,221,373 A * 9/1980 Hans ..... B65H 45/12 270/52.26
4,793,227 A * 12/1988 Stobb ..... B26D 1/035 83/151
5,921,752 A * 7/1999 Sinke ..... B42B 4/00 416/16
6,029,884 A * 2/2000 Roeland ..... B31B 1/00 206/455
6,360,514 B1 * 3/2002 Detterman ..... B65B 5/024 493/59
6,478,725 B1 * 11/2002 Bengt ..... B26D 1/245 493/59
6,547,231 B1 * 4/2003 Chick ..... B42C 1/10 270/52.19
7,201,089 B2 * 4/2007 Richter ..... B65H 5/30 270/52.17
7,537,557 B2 * 5/2009 Holler ..... B65H 45/22 493/241
2002/0022560 A1 * 2/2002 Zoeckler ..... B31B 1/25 493/343
2002/0059979 A1 * 5/2002 Machon ..... B42C 7/00 156/256
2002/0061240 A1 * 5/2002 Beermann ..... B42C 7/00 412/19

(Continued)

FOREIGN PATENT DOCUMENTS

CN 101200091 A * 6/2008
CN 101200091 B 8/2010

(Continued)

*Primary Examiner* — Hemant M Desai
*Assistant Examiner* — Tanzim Imam
(74) *Attorney, Agent, or Firm* — Alix, Yale & Ristas, LLP

(57) ABSTRACT

The apparatus (1) includes a horizontally supported transport drum (11), spaced-apart endless belts (51) that revolve around rollers (54.1 to 54.8) and are partially wrapped around the transport drum (11) such that an infeed (14) and an outlet (15) are formed and the cardboard cuttings (2, 3) are pressed against and conveyed on the drum. Groove cutting tools (72) are arranged between the belts (51). In order to allow a visual inspection of the cut grooves (3*a*) from above during the operation of the apparatus, the outlet (15) is situated in the region of the upper vertex of the transport drum (11). The delivery of the grooved cardboard cuttings (3) at the upper vertex of the transport drum (11) also results in an ergonomically advantageous removal height.

20 Claims, 6 Drawing Sheets

(56) References Cited

U.S. PATENT DOCUMENTS

| | | | | |
|---|---|---|---|---|
| 2004/0138037 | A1* | 7/2004 | Kruger | B31B 1/20 493/79 |
| 2008/0108490 | A1* | 5/2008 | Kocherga | B31B 1/25 493/59 |

FOREIGN PATENT DOCUMENTS

| | | | |
|---|---|---|---|
| CN | 102166834 | A | 8/2011 |
| CN | 201970485 | U | 9/2011 |
| CN | 202412794 | U | 9/2012 |

* cited by examiner

APPARATUS FOR GROOVING CARDBOARD CUTTINGS

BACKGROUND

The present invention pertains to an apparatus for grooving cardboard cuttings.

Book cases, as well as boxes for high-quality sales and gift packages, essentially consist of cardboards that are lined with cloth materials. In order to prepare bending points or sharp-edged bends, the cardboard cuttings are grooved at the corresponding locations. The groove cross section may have any profile from triangular to rectangular that is cut out of the cardboards in the form of waste with knife blades that are accordingly aligned relative to one another or circular knives and, if applicable, an intermediately arranged lift-out device or with one-piece special knives that are shaped in accordance with the respective cross section.

CN 101200091 B discloses a corresponding cardboard grooving machine, in which the infeed is situated at the upper vertex and the outlet is situated at the lower vertex of the transport drum, wherein said cardboard grooving machine has a common operating side for feeding and removing the cardboard cuttings and an opposite tool side. Due to the ground clearance required at the lower outlet for the stacking process and the relatively large drum diameter required for ensuring a flawless transport, the horse is elevated in such a way that the cardboard cuttings can only be fed from a pedestal while the grooved cardboard cuttings effectively need to be removed from the ground. Another disadvantage can be seen in that the cardboard cuttings are delivered with the grooved side on the bottom such that a continuous visual quality control cannot be carried out and the respective grooving result instead needs to be controlled by removing and turning individual cardboard cuttings.

CN 102166834 A describes a cardboard grooving machine of the same type, in which the infeed is situated at the lower vertex of the transport drum, wherein the grooved cardboard cuttings are also ejected onto a delivery table on the opposite side with the grooved side on the bottom. Although the feed and the removal of the cardboard cuttings are ergonomically improved, access to the cutting tools for adjustments and corrections thereof is blocked by the delivery table.

SUMMARY

The object of the present invention is to provide a grooving apparatus, by means of which positionally accurate, cross-sectionally accurate and clean grooves can be cut into cardboard cuttings in a simple and user-friendly fashion.

According to the disclosure, the outlet is situated in the region of the upper vertex of the transport drum such that the cut grooves of the cardboard cuttings being delivered point upward. In this way, the cut grooves are visible from above during the operation of the apparatus and the groove quality can be continuously assessed on any of the cardboards being delivered without having to remove individual cardboard cuttings. This also makes it possible, in particular, to detect any waste that might still remain on the cardboard or in the grooves. This waste can be simply blown away or brushed away because it is situated on the upper side of the cardboard rather than on its underside. The delivery of the cardboards with the grooves pointing upward furthermore allows the direct subsequent processing in downstream devices such as, e.g., a laminating machine, in which the cardboards are glued onto cloth materials with the groove-free bottom side, without having to turn over the cardboard cuttings. The delivery of the grooved cardboard cuttings at the upper vertex of the transport drum also results in an ergonomically advantageous removal height, in particular, if the cardboards are dropped from the outlet onto a delivery table arranged at a lower height.

In an enhancement, first rollers are arranged a certain distance in front of the outlet such that the belts have a segment that tangentially extends away from the transport drum. This makes it possible to significantly reduce an undesirable flexing and bending effect in the outlet and the cardboards are delivered in a nearly planar fashion. In addition, a further transport can also be realized in this way, for example, by means of a roller carpet arranged thereunder or by utilizing belts in the form of suction belts.

The manual removal respectively can be further rationalized or prepared for a mechanized removal by providing a stacking device that is arranged downstream of the outlet and respectively forms or delivers a stack on a plane that lies lower than the outlet. Since the respective cardboard cutting grooved last lies on the top of the stack with the grooved side pointing upward, a visual quality control can be easily carried out during the stacking onto pallets without having to remove a cardboard cutting from the stack.

Unobstructed access to the transport drum is ensured due to the fact that, according to an enhancement, the grooved cardboard cuttings are transported away by a conveyor belt that extends transverse to the outlet, for example, in order to transfer the cardboard cuttings to an adjoining coupled subsequent processing device. If the grooved cardboard cuttings are deposited and transported away on the conveyor belt in the form of an imbricated stream, in which the cardboard cuttings lie underneath one another toward the front, an effectively endless stack is formed that can be removed in arbitrary partial quantities independently of the machine cycle. In addition, the imbricated further transport allows a visual inspection of at least an area of the cut grooves on all cardboard cuttings.

In an enhancement, the feed to the infeed and the delivery from the outlet take place on the same side of the transport drum referred to a vertical plane defined by the drum axis such that a user-friendly feed and removal of the cardboard cuttings can be realized on a common operating side and the groove cutting tools can be arranged on the opposite tool side such that they are easily accessible and accumulating waste can be freely discharged.

The infeed preferably is situated in the region of the lower vertex of the transport drum, wherein the cardboard cuttings are transported to the infeed by conveyor means in an essentially flat fashion. The cardboard cuttings are transported to the transport drum tangentially and received by the infeed in their flat orientation. The design with the infeed at the lower vertex and the outlet at the upper vertex results in a wrap angle of the belts around the transport drum of about 180° and therefore a sufficiently long transport section for positioning different cutting and processing tools that are arranged successively in the transport direction.

A feed conveyor with cardboard pushers that push on the rear edge of the cardboards is preferably provided in order to transport the cardboard cuttings to the infeed with a slightly higher speed than the transport drum while they are laterally aligned on guide rails. The cardboard cuttings are exactly aligned on the rear edge and one lateral edge and effectively forced into the infeed between transport drum and belt in this orientation due to the excess speed. The processing is carried out in a cyclic fashion such that it is possible to respectively realize a direct transfer to and from synchronized upstream and downstream machines. Since the respective transport position of the cardboard cuttings is known during said cyclic processing, certain processing steps that are dependent on the vertical position such as punching out corners or producing transverse grooves or the like can be carried out on the individual cardboard cuttings in addition to the grooving process.

Second rollers preferably are arranged a certain distance in front of the infeed such that the belts have a segment that tangentially extends toward the transport drum. In addition to significantly reducing the flexing and bending effect in the infeed, the conveyor segment supports the alignment of the cardboard cuttings on the slightly faster moving cardboard pushers of the feed conveyor.

In an enhancement, a cardboard magazine for accommodating a stack of cardboard cuttings is provided, wherein the respective bottom cardboard cutting can be removed from said cardboard magazine and transported to the infeed. Further cardboards can then be fed to the grooving apparatus without being held at a higher and therefore ergonomically more advantageous infeed height. The cardboard magazine is realized in the form of a buffer that operates in accordance with the FiFo (First-in-First-out) principle and particularly advantageous for the coupling of the grooving apparatus to an upstream machine. The advantages of a further increased storage capacity and an additionally improved ergonomic infeed height are achieved by assigning the cardboard magazine a pre-stacking belt for receiving cardboard cuttings that are fed in an imbricated fashion or in the form of stacks, wherein said pre-stacking belt automatically feeds the cardboard cuttings to the cardboard magazine in accordance with the magazine filling level.

In an enhancement, two transport regions lie adjacent to one another on the transport drum and respectively feature at least one groove cutting tool such that a first and a second processing section with separate first and second infeeds and outlets are formed in the grooving apparatus. This makes it possible, in particular, to groove cardboard cuttings to be grooved in a double-crossed fashion in directly successive processing steps in one grooving apparatus because the cardboard cuttings being delivered at the first outlet can be directly fed to the second infeed of the grooving apparatus without intermediate depositing. The double-crossed grooving can be further automated if the cardboard cuttings being delivered at the first outlet are automatically transferred to the second infeed while simultaneously being turned and/or turned over by transport and/or guide means.

In an enhancement, a gluing device with at least one application means arranged at a defined distance from the drum surface is provided. In this way, glue can be applied onto the grooved side of the cardboard cuttings during the transport on the transport drum in order to glue additional cardboard parts, cloth materials or the like onto the grooved cardboard cuttings immediately after the grooving process. Glue can be introduced into the previously cut grooves by an application means in the form of an application wheel or application nozzle that follows and is aligned with the at least one groove cutting tool such that the cardboard cutting can subsequently be folded and joined into a box without having to glue paper strips over the edges.

In an enhancement, circular knives are arranged upstream of the infeed and/or downstream of the outlet such that the cardboard cuttings can be simultaneously trimmed to the desired width and/or height during the groove cutting process.

In an enhancement, punching tools are arranged upstream of the infeed and/or downstream of the outlet such that corners and/or holes can be simultaneously punched out of the cardboard cuttings during the groove cutting process.

In other embodiments, the grooving apparatus is coupled to a downstream box folding and joining device or to an upstream or downstream laminating device, in which the cardboard cuttings are respectively lined with a blank to be covered on the outer side and/or inner side.

BRIEF DESCRIPTION OF THE DRAWING

Different embodiments and applications of the inventive grooving apparatus are described in detail below with reference to the following figures. In these figures.

DETAILED DESCRIPTION

Figure 1:
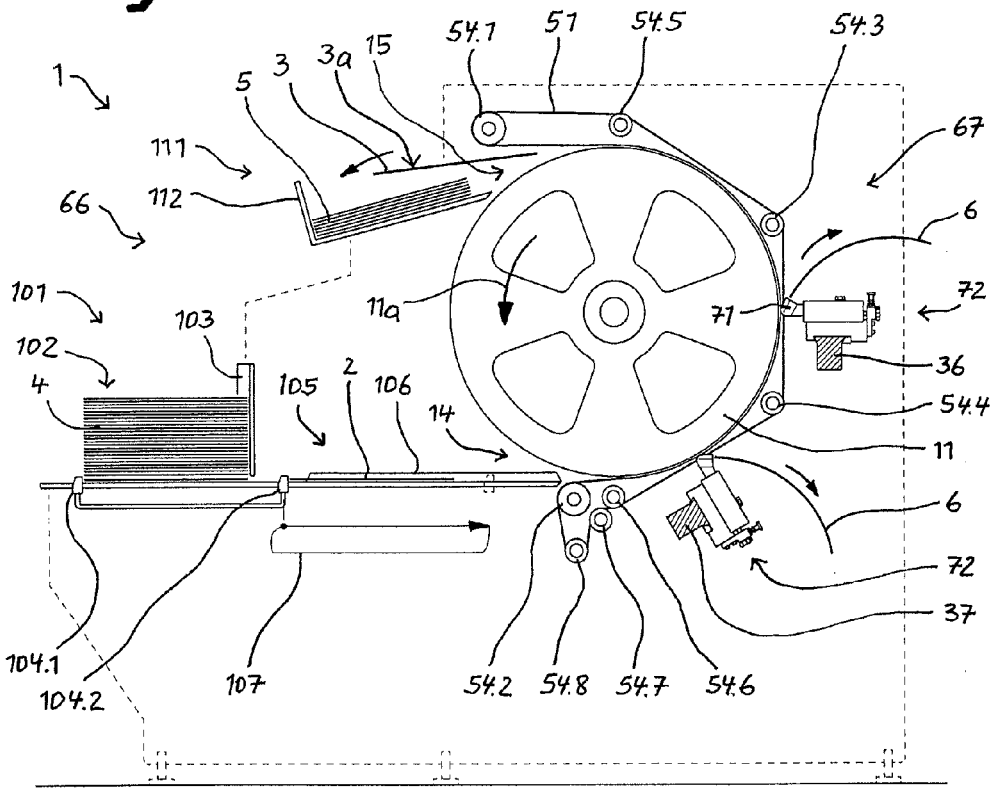
FIG. 1 shows a schematic side view of a grooving apparatus.

The grooving apparatus 1 schematically illustrated in FIG. 1 comprises a driven, horizontally supported transport drum 11 and several spaced-apart endless belts 51 that revolve around rollers 54.1 to 54.8 and are partially wrapped around the transport drum 11 such that an infeed 14 and an outlet 15 are formed, as well as groove cutting tools 72 that are arranged between the belts 51 at a defined distance from the drum surface. Cardboard cuttings 2 transported to the infeed 14 by a feed device 101 are pressed onto the drum surface in an effectively conveying fashion by the belts 51 and transported from the infeed 14 situated at the lower vertex of the transport drum 11 to the outlet 15 situated at the upper vertex in the transport direction 11*a* during an approximately 180° rotation of the transport drum 11, wherein the cardboard cuttings are during this process guided past groove cutting tools 72, at which, for example, a V-shaped waste section 6 is cut out of the cardboard cuttings 2 with correspondingly shaped grooving knives 71.

The feed device 101 in FIG. 1 features a cardboard magazine 102 that can be filled in an ergonomically advantageous fashion and contains a stack 4 of cardboard cuttings that lie on top of one another. The respective bottom cardboard cutting 2 is ejected underneath a front stop 103 by a first cardboard pusher 104.1 and transferred into an intermediate position 105, from which the cardboard cutting 2 is transported to the infeed 14 by a second cardboard pusher 104.2 while being aligned on outer guide rails 106. The cardboard pushers 104.1, 104.2 are coupled at a fixed distance from one another and cyclically moved forward and backward with a constant transport stroke 107 that corresponds to this fixed distance. In this case, the transport speed is slightly higher than the rotational speed of the transport drum 11 such that the cardboard cuttings 2 effectively are forcibly pushed into the infeed 14 between transport drum 11 and belt 51.

Since the rollers 54.2 are arranged a certain distance in front of the infeed 14, the belts 51 have a segment that tangentially extends toward the transport drum 11. In this way, flexing and bending are significantly reduced in the infeed 14. In addition, the segment supports the alignment of the cardboard cuttings 2 on the slightly faster moving cardboard pushers 104.2 of the feed device 101.

The delivery 111 in FIG. 1 features a delivery table 112 that downwardly slopes obliquely forward, wherein the completely grooved cardboard cuttings 3 exiting the outlet 15 are dropped onto the delivery table and placed on top of one another in order to form a stack 5. Since the outlet 15 is arranged at the upper vertex of the transport drum 11, the cut grooves 3 lie on the upper side of the exiting cardboard cuttings 3. Consequently, the cut grooves 3*a* are visible from above during the operation of the apparatus and the groove quality can be continuously assessed on any of the cardboards being delivered without having to remove individual cardboard cuttings 3. The delivery of the grooved cardboard cuttings 3 at the upper vertex of a transport drum 11 and the depositing on the delivery table 112 arranged at a lower height furthermore result in an ergonomically advantageous removal height.

Since the rollers 54.1 are arranged a certain distance in front of the outlet 15, the belts 51 have a segment that tangentially extends away from the transport drum 11. In this way, flexing and bending are significantly reduced in the outlet 15 and the grooved cardboard cuttings 3 are delivered in a nearly planar fashion.

The delivery 111 and the feed device 101 lie on the same horizontal side of the transport drum 11, namely the so-called operating side 66, while the groove cutting tools 72 are situated on the opposite tool side 67 and freely accessible.

Figure 2:
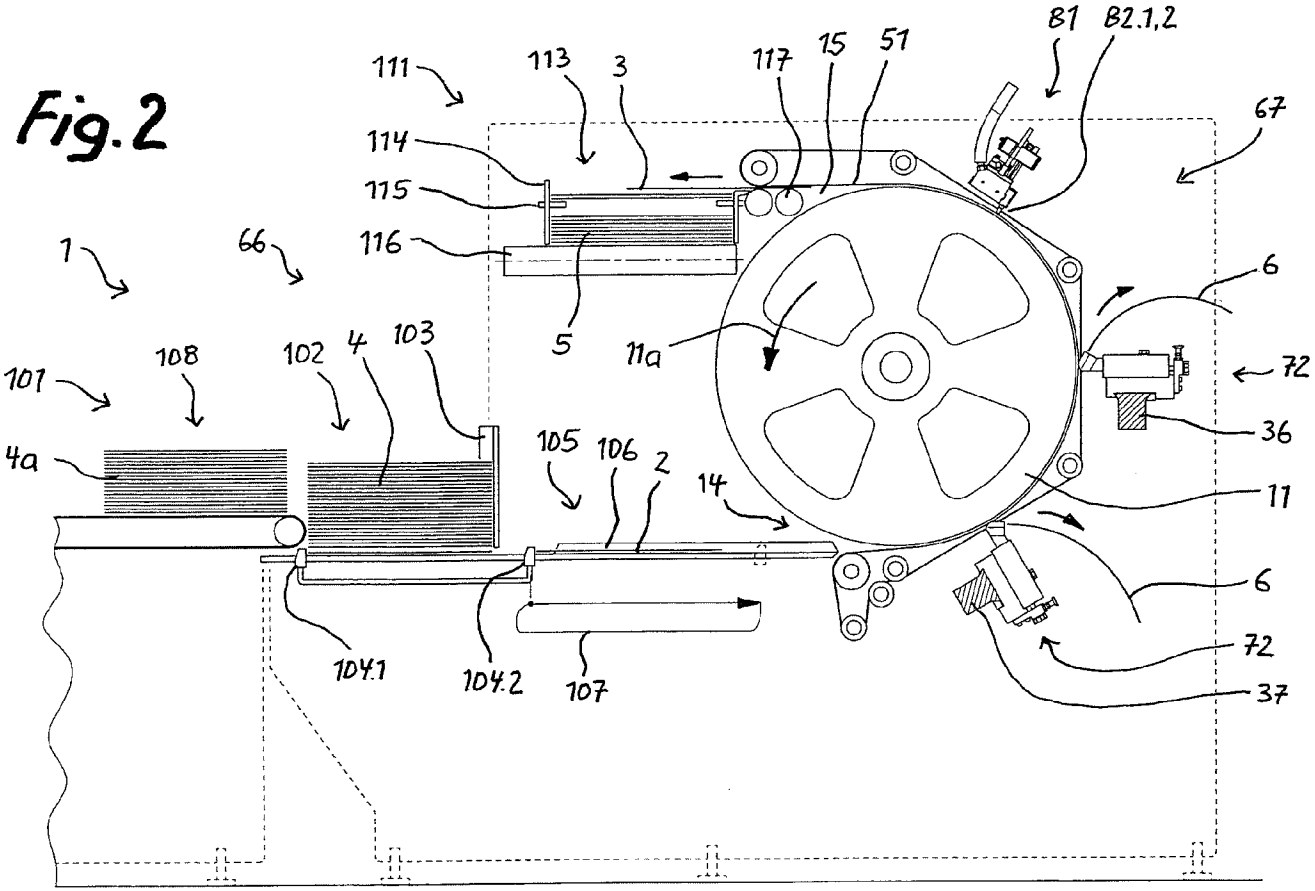
FIG. 2 shows the grooving apparatus with a pre-stacking belt and a stacking device, as well as a gluing device.

FIG. 2 shows the grooving apparatus 1 with a pre-stacking belt 108 that is arranged upstream of the cardboard magazine 102 of the feed device 101. The pre-stacking belt receives cardboard cuttings 2 in imbricated form or in stacks 4*a* and automatically delivers these cardboard cuttings to the cardboard magazine 102. The pre-stacking belt 108 provides a larger storage capacity and ergonomically improves the infeed height due to its higher transport plane.

A stacking device 113 is furthermore provided in the delivery 111 of the grooving apparatus 1 according to FIG. 2. The stacking device features a shaft 114 with a rake-like intermediate bottom 115 that can be opened and closed and a conveyor belt 116 that lies underneath this intermediate bottom and transports away the cardboard cuttings 3 lying on top of one another in the form of a stack 5 transverse to the transport direction 11*a*. The segments of the belts 51 that tangentially and horizontally extend away from the transport drum 11 and pressure rollers 117 arranged thereunder jointly form an additional conveyor, by means of which the cardboard cuttings 3 being delivered are transported as far as the shaft 114.

According to FIGS. 1 and 2, the rollers 54.1 to 54.8 are arranged around the transport drum 11 in such a way that a total of three areas of closest approach between the belt outer segments that lie between the rollers 54.5 and 54.3, 54.3 and 54.4, 54.4 and 54.6 and the belt inner segments adjoining the transport drum 11 are formed in the exemplary embodiments. According to FIG. 2 and FIG. 4, the groove cutting tools 72 and a gluing device 81 with adjacently arranged application nozzles 82.1, 82.2 may be arranged between belts and adjacent to these areas. The gluing device 81 is described in greater detail further below.

The groove cutting tools 72 are mounted on supporting beams 36, 37 that lie parallel to the axis of transport drum 11. Several groove cutting tools 72 may be mounted adjacent to one another on the same supporting beam. Grooves 3*a* that lie very close to one another can be produced due to the arrangement on two supporting beams 36, 37 that lie behind one another in the transport direction 11*a*.

Figure 6:
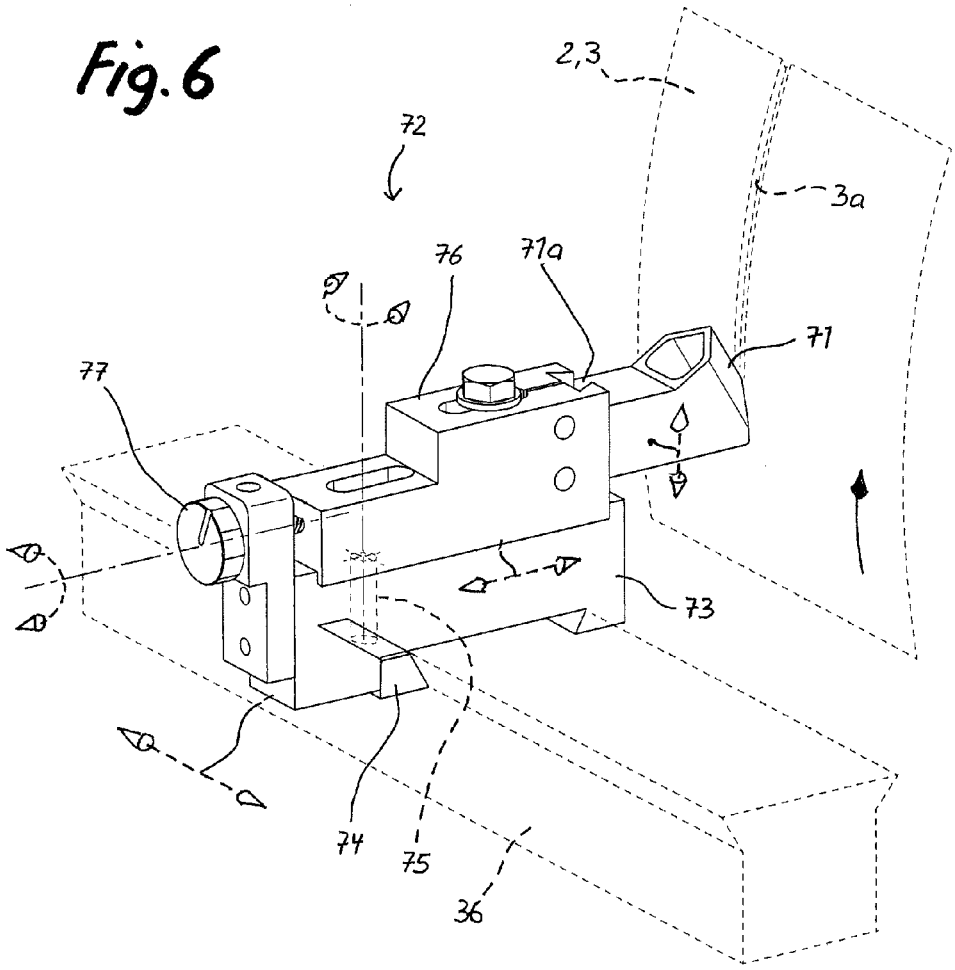
FIG. 6 shows a groove cutting tool fitted with a grooving knife.

FIG. 6 shows an example of a groove cutting tool 72. It comprises a carrier 73 that can be fixed on the supporting beam 36 with a clamping block 74 that is actuated by means of a clamping screw 75. A receptacle slide 76 for the grooving knife 71 provided with a dovetail guide 71*a* mounted on the carrier 73. After loosening the clamping block 74, the groove cutting tool 72 can be displaced axially referred to the transport drum 11 such that the position of the groove 3*a* to be cut in the cardboard cutting 3 can be changed. In addition, the receptacle slide 76 can be released and displaced in small increments radially referred to the transport drum 11 by means of a dial 77 such that the respective cutting depth can be adjusted. The grooving knife 71 ultimately can also be adjusted transverse to the two aforementioned adjusting directions by means of its dovetail guide 71*a*.

Figure 3:
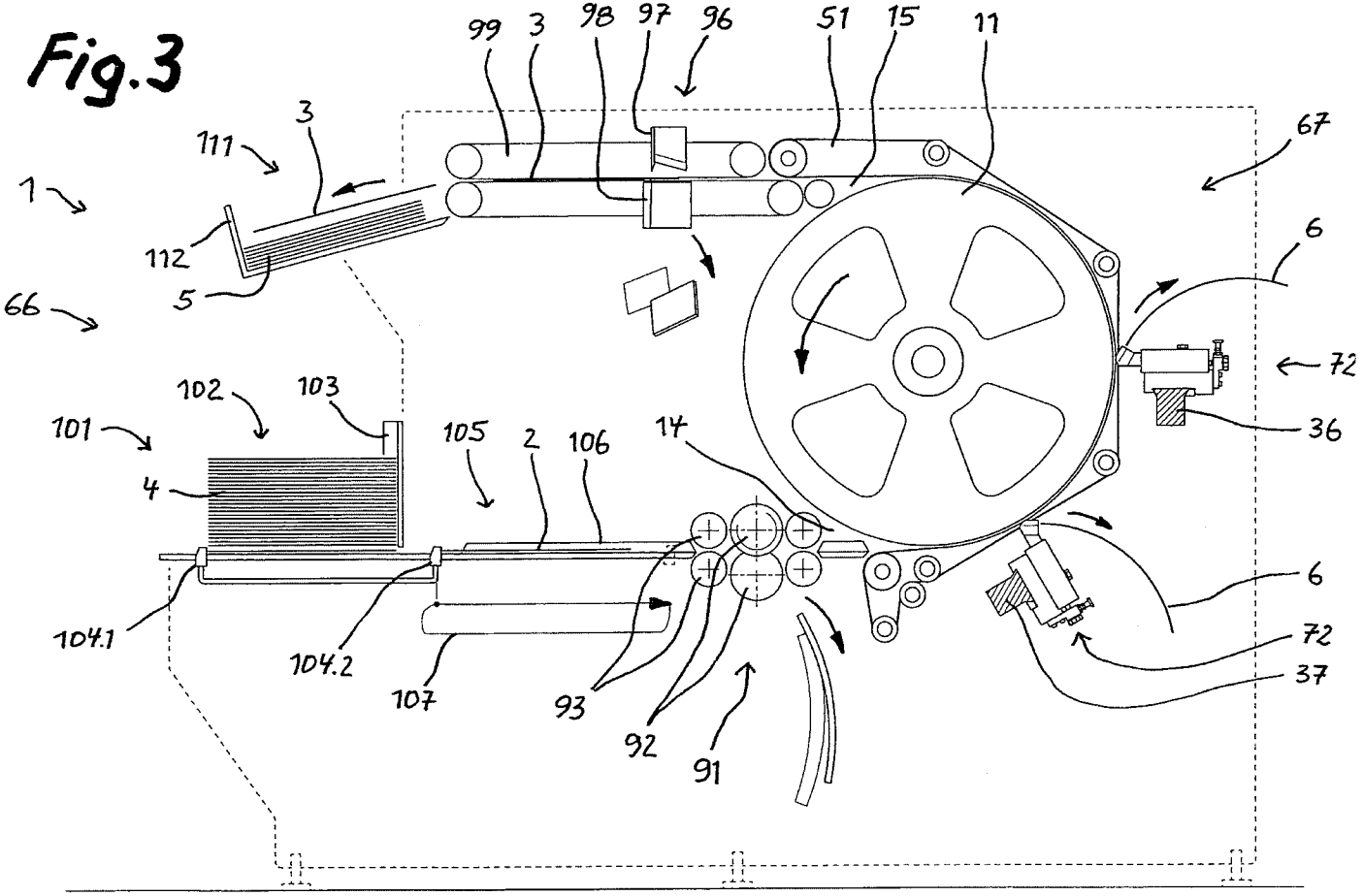
FIG. 3 shows the grooving apparatus with integrated cardboard cutting and punching devices.

FIG. 3 shows the grooving apparatus 1 with a cardboard cutting device 91 that is integrated into the feed device 101 and features circular knives 92 that trim the cardboard cuttings 2 to the desired width and/or height by means of a shearing cut, as well as transport rollers 93 arranged upstream and downstream thereof. Furthermore, a punching device 96 is integrated into the delivery 111 and features one or more punching knives 97 that are moved vertically up and down, against a corresponding counter knife 98, as well as an intermittently driven clamping belt conveyor 99, by means of which the cardboard cuttings 3 received from the transport drum 11 are transferred into the respective punching position and subsequently transported away to the delivery table 112. The punching device 96 makes it possible to punch corners and/or holes out of the cardboard cuttings 3 during the groove cutting process. However, the punching device 96 may also be integrated into the feed device 101 and the cardboard cutting device 91 may vice versa be arranged in the delivery 111.

Figure 4:
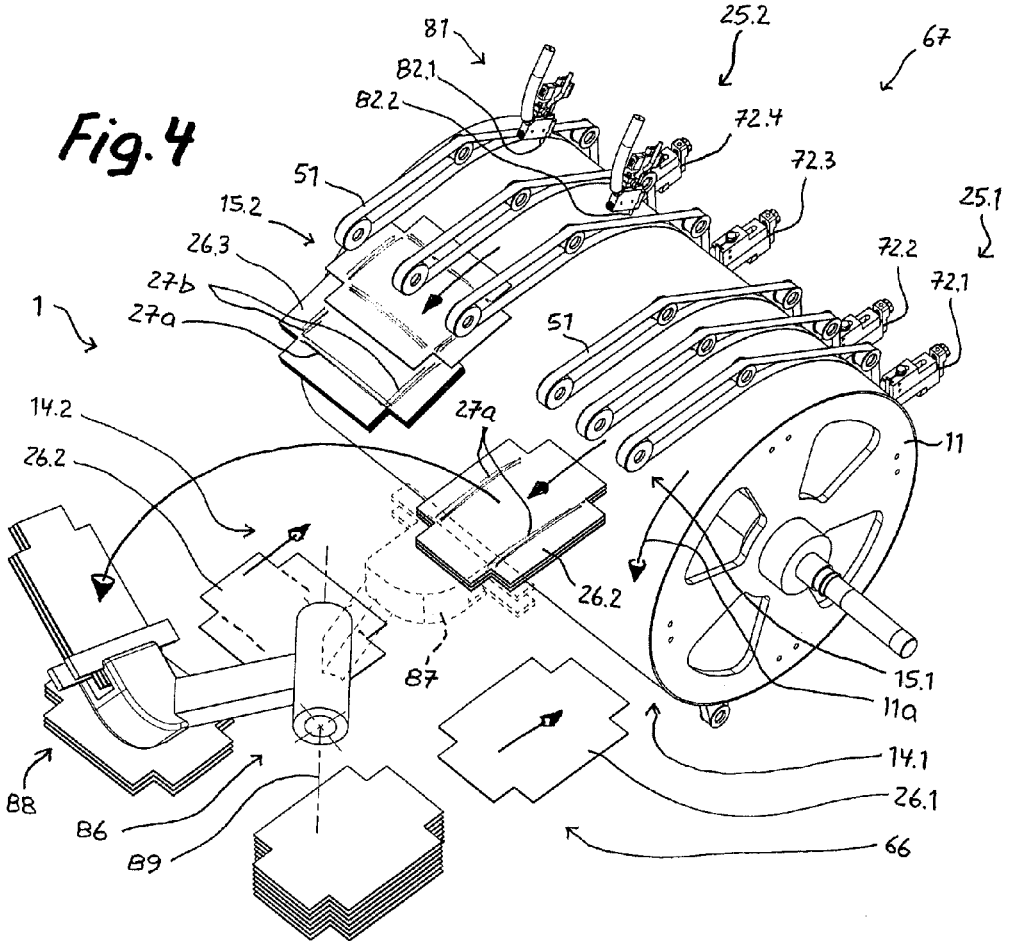
FIG. 4 shows a partially schematic perspective representation of the grooving apparatus with two adjacent processing sections.

FIG. 4 shows a partially schematic perspective representation of the grooving apparatus 1, in the form of an embodiment with two processing sections 25.1, 25.2 that lie adjacent to one another and respectively feature three parallel belts 51 that are spaced apart from one another, as well as groove cutting tools 72.1, 72.2 and 72.3, 72.4 arranged between the belts 51. In addition, a gluing device 81 is provided in the second processing section 25.2 and features two application nozzles 82.1, 82.2 that respectively are arranged downstream of and in alignment with the groove cutting tools 72.3, 72.4 and apply glue 83 into the previously cut grooves 27*b*.

The grooving apparatus 1 illustrated in FIG. 4 makes it possible to groove cruciform punched cardboard cuttings 26.1 in a double-crossed fashion on one grooving apparatus 1 in immediately successive production steps. To this end, the cardboard cuttings 26.1 are fed to the transport drum 11 through the first infeed 14.1 and delivered at the first outlet 15.1 in the form of longitudinally grooved cardboard cuttings 26.2 featuring two grooves 27*a* extending along the transport direction 11*a*, wherein these cardboard cuttings are then transferred stack-by-stack from the receiving position 87 at the first outlet 15.1 into a delivery position 88 at the second infeed 14.2 by means of a pivoted gripper 86, and wherein the cardboard cuttings 26.2 are once again individually removed from said delivery position and transported to the second processing section 25.2, from which they emerge in the form of cardboard cuttings 26.3 grooved in a double-crossed fashion at the second outlet 15.2.

In this case, the cardboard cuttings 26.2 are turned and turned over by the pivoted gripper 86 that pivots about a horizontal pivoting axis 89 that is inclined relative to the drum axis by 45° in such a way that the grooved side, which still lies on the top at the first outlet 15.1, once again lies on the bottom at the second infeed 14.2 and the already produced grooves 27*a* are oriented transverse to the transport direction 11*a*. The longitudinally grooved cardboard cuttings 26.2 may also be manually transferred from the first outlet 15.1 to the second infeed 14.2.

Figure 4A:
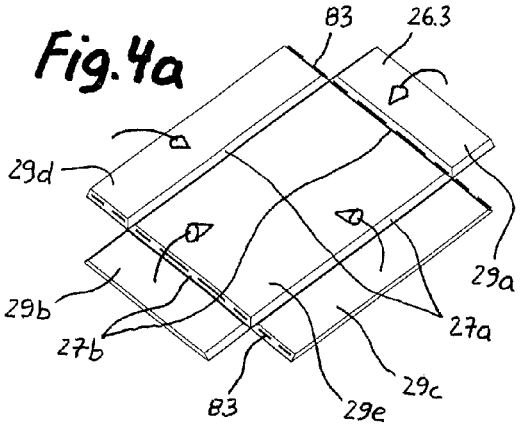
FIG. 4*a* shows a cardboard cutting that was punched out in a cruciform and grooved in a double-crossed fashion.
Figure 4B:
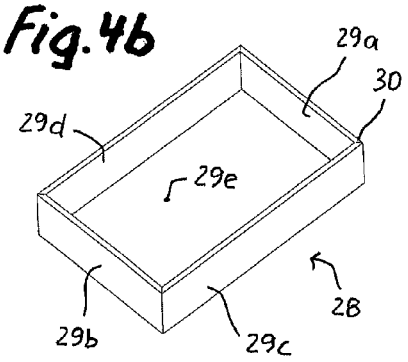
FIG. 4*b* shows a box.

FIG. 4*a* shows a flat cardboard cutting 26.3 that was grooved with V-grooves 27*a*, 27*b* in a double-crossed fashion. The grooves 27*b* produced in the second processing section 25.2 are provided with a glue application 83. A box 28 of the type illustrated in FIG. 4*b* is formed by folding the sidewalls 29*a* to 29*d* arranged around a bottom 29*e* in the cardboard cutting 26.3 into an upright position, wherein the respectively joined edges of the sidewalls 29*a* to 29*d* form a miter joint 30 that is glued together by the glue application 83. The box 28 is joined without gluing paper strips over the edges. The box 28 that is lined with a cover in a subsequent processing step therefore does not feature any uneven regions caused by such paper strips and also has sharp outer edges.

Figure 5:
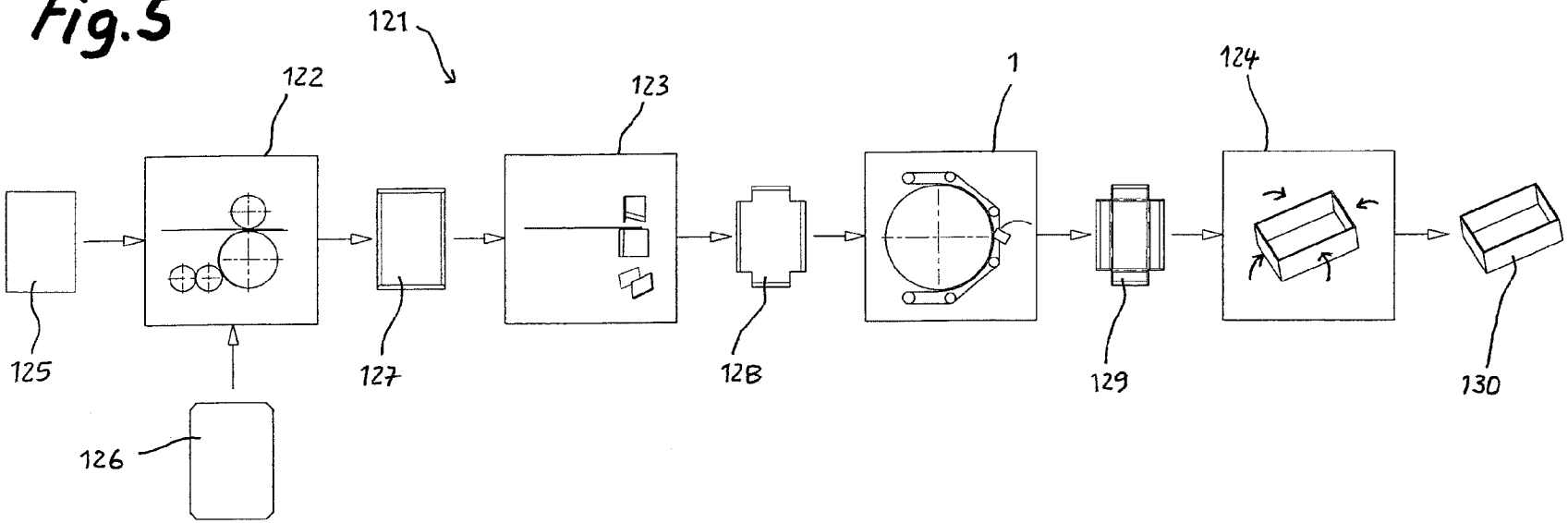
FIG. 5 shows a schematic representation of a box production line.

FIG. 5 shows a schematic representation of a box production line 121 consisting of a laminating device 122 that glues the entire surface of a blank to be covered 126 onto a cardboard cutting 125 and folds over its edges, a punching device 123 for punching the corners out of the lined cardboard cutting 127, the grooving apparatus 1 according to FIG. 4 for grooving the cruciform cardboard cutting 128 in a double-crossed fashion and a box folding and joining device 124 for folding and joining the grooved cardboard cutting 129 into a box 130. The laminating device 122 and/or the punching device 123 may also be arranged downstream of the grooving apparatus 1 in the box production line 121.

The invention claimed is:

1. An apparatus for grooving cardboard cuttings (2, 3), comprising:

a transport drum (11) rotationally driven about a horizontal axis at a drum speed and having upper and lower vertices;

a plurality of endless belts (51) spaced axially apart along the transport drum, said belts revolving around rollers (54.1 to 54.8) and partially wrapping around the transport drum (11) such that an infeed (14) and an outlet (15) for the cardboard cuttings are formed and the cardboard cuttings (2, 3) are pressed and conveyed against the drum surface from the infeed to the outlet; and at least one groove cutting tool (72) arranged between the belts (51) at a distance from the drum surface;

wherein the outlet (15) is situated at the upper vertex of the transport drum (11), and the infeed is located at the lower vertex of the transport drum;

the cardboard cuttings (3) with cut grooves are delivered from the outlet with the grooves facing upward; and the cardboard cuttings are fed to the transport drum at a front side of the transport drum and first rollers (54.2) are arranged a distance in front of the infeed (14) such that the belts (51) have a segment that tangentially extends toward the transport drum (11), whereby the cardboard cutting passes between the transport drum and said segment of the belts toward said infeed.

2. The apparatus according to claim 1, wherein the outlet delivers grooved cardboard cuttings to a front side of the transport drum and second rollers (54.1) are arranged a sufficient distance in front of the outlet (15) such that the belts (51) have a segment that tangentially separates from the transport drum (11).

3. The apparatus according to claim 1, including a stacking device (112, 113) which is arranged downstream of the outlet (15) and which either forms or delivers a stack (5) of grooved cardboard cuttings on a planar surface that lies at an elevation lower than that of the outlet (15).

4. The apparatus according to claim 1, wherein the grooved cardboard cuttings (3) are transported away by a conveyor belt (116) that extends transverse to the outlet (15).

5. The apparatus according to claim 1, wherein the infeed (14) of cardboard cuttings to the transport drum and the delivery (111) of grooved cardboard cuttings from the outlet (15) both occur on the same side of a vertical plane on which the axis of rotation of the transport drum lies.

6. The apparatus according to claim 1, including a cardboard magazine (102) that accommodates a stack (4) of cardboard cuttings including a bottom cardboard cutting and from which the bottom cardboard cutting (2) is removed and transported to the infeed (14).

7. The apparatus according to claim 6, including a prestacking belt (108) operatively associated with the cardboard magazine for automatically feeding cardboard cuttings (2) in an imbricated form or in the form of stacks (4*a*) to the cardboard magazine (102) in accordance with a magazine filling level.

8. The apparatus according to claim 1, wherein the belts define at least two transport regions that lie adjacent to one another on the transport drum (11), each transport region having an associated at least one groove cutting tool (72.1, 72.2, 72.3, 72.4) whereby first and second processing sections (25.1, 25.2) with separate first and second infeeds (14.1, 14.2) and outlets (15.1, 15.2) are formed.

9. The apparatus according to claim 8, including means for receiving and at least one of turning or turning over, grooved cardboard cuttings from the first outlet and means (86) for transferring the turned or turned over cardboard cuttings (26.2) to the second infeed (14.2).

10. The apparatus according to claim 1, including a gluing device (81) with at least one applicator (82.1, 82.2) arranged at a distance from the drum surface.

11. The apparatus according to claim 10, wherein the applicator comprises a wheel or nozzle (82.1, 82.2) that is arranged downstream of and in alignment with one of the at least one groove cutting tool (72.3, 72.4).

12. The apparatus according to claim 1, including circular trim knives (92) arranged upstream of the infeed (14) and/or downstream of the outlet (15).

13. The apparatus according to claim 1, including punching tools (97, 98) arranged upstream of the infeed (14) and/or downstream of the outlet (15).

14. The apparatus according to claim 1, wherein the apparatus is coupled with a downstream box folding and joining device (124).

15. The apparatus according to claim 1, wherein the apparatus is coupled with at least one upstream or downstream laminating device (122).

16. An apparatus for grooving cardboard cuttings (2, 3), comprising:

a transport drum (11) rotationally driven about a horizontal axis at a drum speed and having upper and lower vertices;

a plurality of endless belts (51) spaced axially apart along the transport drum, said belts revolving around rollers (54.1 to 54.8) and partially wrapping around the transport drum (11) such that an infeed (14) and an outlet (15) for the cardboard cuttings are formed and the cardboard cuttings (2, 3) are pressed and conveyed against the drum surface from the infeed to the outlet; and at least one groove cutting tool (72) arranged between the belts (51) at a distance from the drum surface;

wherein the outlet (15) is situated at the upper vertex of the transport drum (11), the cardboard cuttings (3) with cut grooves are delivered from the outlet with the grooves facing upward;

the infeed (14) is situated at the lower vertex of the transport drum (11) and a feed conveyor transports cardboard cuttings (2) to the infeed (14) tangentially to the transport drum (11); and the feed conveyor has pushers (104.1, 104.2) that push on rear edges of the cardboard cuttings (2) toward the infeed at a speed that exceeds the speed of the transport drum and has guide rails that laterally align the pushed cardboard cuttings.

17. The apparatus of claim 16, wherein first rollers (54.2) are arranged a distance in front of the infeed (14) such that the belts (51) have a segment that tangentially extends toward the transport drum (11), whereby the cardboard cutting passes between the transport drum and said segment of the belts toward said infeed.

18. An apparatus for grooving cardboard cuttings (2, 3), comprising:

a transport drum (11) rotationally driven about a horizontal axis of rotation at a drum speed and having upper and lower vertices and a front side and a back side;

a plurality of endless belts (51) spaced axially apart along the transport drum, said belts revolving around rollers (54.1 to 54.8) and wrapping around the back side of the transport drum (11) such that an infeed (14) and an outlet (15) for the cardboard cuttings are formed at the front side of the transport drum and the cardboard cuttings (2, 3) are pressed and conveyed against the drum surface of the back side of the drum from the infeed to the outlet; and at least one groove cutting tool (72) arranged at the back side of the transport drum between the belts (51) at a distance from the drum surface;

wherein the infeed is situated at the lower vertex of the transport drum and the outlet (15) is situated at the upper vertex of the transport drum;

the cardboard cuttings (3) with cut grooves are delivered from the outlet with the grooves facing upward;

first rollers (54.1) are arranged a distance in front of the outlet (15) such that the belts (51) have a segment that tangentially separates from the transport drum (11);

second rollers (54.2) are arranged a distance in front of the infeed (14) such that the belts (51) have a segment that tangentially extends toward the transport drum (11); and a feed conveyor sequentially pushes cardboard cuttings toward the infeed at a speed that exceeds the speed of the transport drum, whereby the cardboard cutting passes between the transport drum and said segment of the belts toward the infeed.

19. An apparatus for grooving cardboard cuttings (2, 3), comprising:

a transport drum (11) rotationally driven about a horizontal axis at a drum speed and having upper and lower vertices;

a plurality of endless belts (51) spaced axially apart along the transport drum, said belts revolving around rollers (54.1 to 54.8) and partially wrapping around the transport drum (11) such that an infeed (14) and an outlet (15) for the cardboard cuttings are formed and the cardboard cuttings (2, 3) are pressed and conveyed against the drum surface from the infeed to the outlet; and at least one groove cutting tool (72) arranged between the belts (51) at a distance from the drum surface;

wherein the outlet (15) is situated at the upper vertex of the transport drum (11), the cardboard cuttings (3) with cut grooves are delivered from the outlet with the grooves facing upward, and the belts define at least two transport regions that lie adjacent to one another on the transport drum (11), each transport region having an associated at least one groove cutting tool (72.1, 72.2, 72.3, 72.4) whereby first and second processing sections (25.1, 25.2) with separate first and second infeeds (14.1, 14.2) and outlets (15.1, 15.2) are formed.

20. The apparatus according to claim 19, including means for receiving and at least one of turning or turning over, grooved cardboard cuttings from the first outlet and means (86) for transferring the turned or turned over cardboard cuttings (26.2) to the second infeed (14.2).

* * * * *